United States Patent [19]

Houweling

[11] 4,301,621

[45] Nov. 24, 1981

[54] ANTI-CLOSING DEVICE FOR DOORS WHICH AUTOMATICALLY OPEN AND CLOSE

[75] Inventor: Hans-Hermann Houweling, Cologne, Fed. Rep. of Germany

[73] Assignee: Gebr. Bode & Co., Kassel, Fed. Rep. of Germany

[21] Appl. No.: 137,374

[22] Filed: Apr. 4, 1980

[30] Foreign Application Priority Data

May 3, 1979 [DE] Fed. Rep. of Germany ..... 2917797

[51] Int. Cl.[3] ..... E05F 15/00

[52] U.S. Cl. ..... 49/27; 200/61.43; 200/153 F; 200/161

[58] Field of Search ..... 49/27, 28, 26; 200/61.43, 329, 153 F, 161

[56] References Cited

U.S. PATENT DOCUMENTS 2,135,131 11/1938 Bassett ..... 49/27 X
3,330,923 7/1967 Brockmeyer et al. ..... 200/61.43
3,352,059 11/1967 Metz ..... 49/27

*Primary Examiner*—Philip C. Kannan
*Attorney, Agent, or Firm*—Hane, Roberts, Spiecens & Cohen

[57] ABSTRACT

Anti-closing device for use with automatically opening and closing doors or the like, having a reversing switch for the door drive and a flexible rope for actuating the switch, the rope being held vertically along the free edge of the door in spaced relation and resiliently tensioned under spring action. One end of the rope is operatively connected to the switch for actuating the switch upon a deflection of the rope. A plurality of sleeves are arranged in a vertical row on the flexible rope and the lower end of the rope is connected to the lowermost sleeve while the uppermost sleeve bears against a support secured to the door whereby the sleeves are pressed against one another by the tensioning of the rope. The end surfaces of the sleeves which face one another bear tightly against each other in the position of rest and have a substantially larger outside diameter than the flexible rope.

18 Claims, 9 Drawing Figures

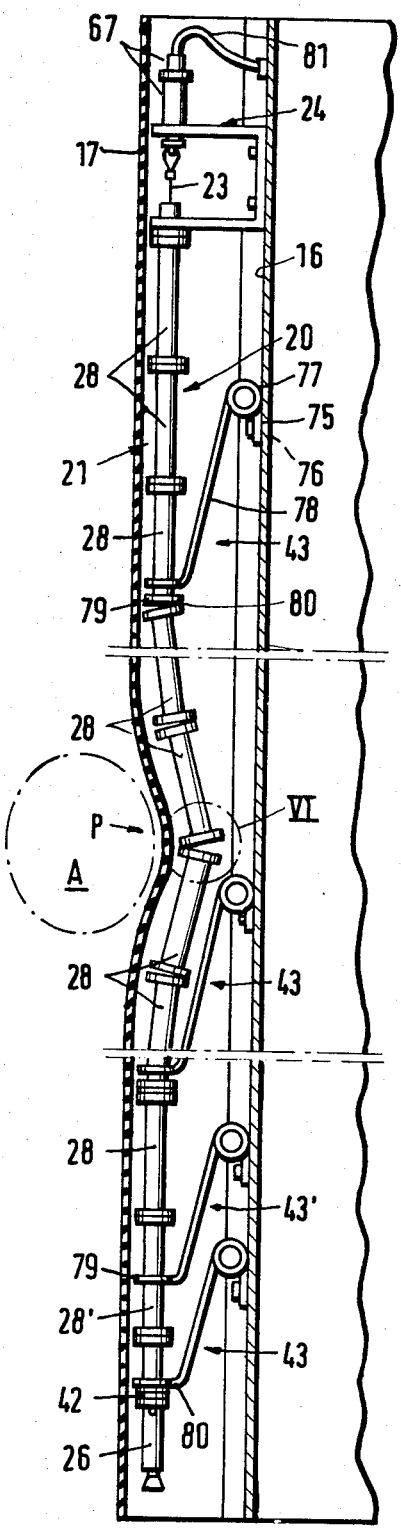
Fig.3
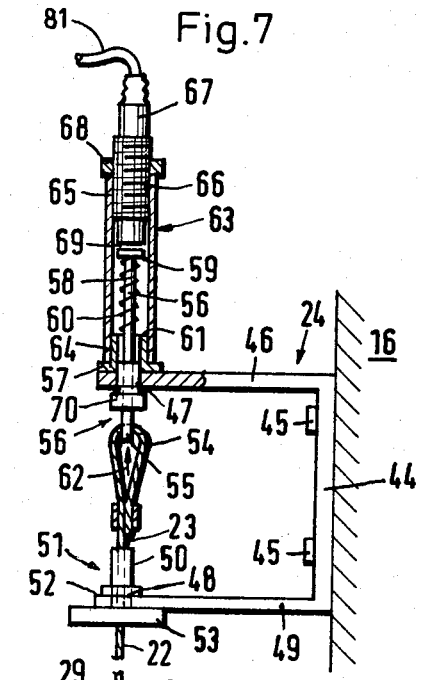
Fig.7
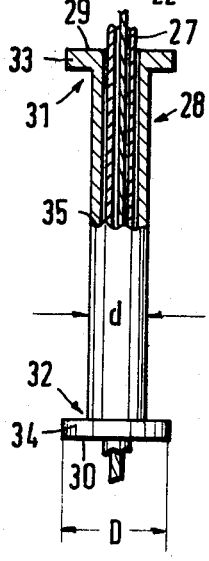
Fig.6
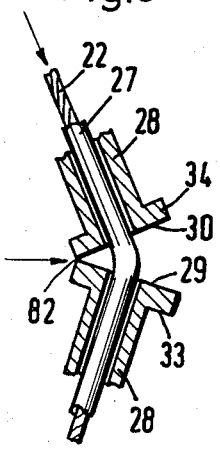

ANTI-CLOSING DEVICE FOR DOORS WHICH AUTOMATICALLY OPEN AND CLOSE

FIELD OF THE INVENTION

This invention relates to an anti-closing device for use with powered doors or the like which automatically open and close and have a switch for operating the door and a flexible pull means for actuating the switch, said pull means being mounted along the free edge of the door in spaced relation therefrom and being tensioned resiliently under spring action, one end of the pull means being in operative connection with the switch for actuating it upon deflection of the pull means.

PRIOR ART

Doors which automatically open and close must be provided with an anti-closing device on the door edges in order to prevent injury to persons who unintentionally enter into the path of the closing door.

It is known to provide a rubber edge guard on automatically opening and closing car doors, said guard being formed as a closed chamber, the interior of which is in communication with a compressed air switch by means of a thin tube or hose. If the chamber is compressed by clamping a hand or foot of a person, the pressure increases to actuate the pressure switch which in turn switches the door drive to "open" so that the door is again opened.

This known anti-closing device has the disadvantage that it can not be mounted continuously down to the lower end of vehicle doors which must be closed over entrance steps. The pneumatically actuated anti-closing device is furthermore very sensitive to temperature, since the air in the tube or hose can expand upon intense solar heating and lead to undesired actuation of the compressed air switch.

In order to avoid these disadvantages, a mechanical anti-closing device of the aforementioned type is known which consists essentially of a flexible wire or rope which is tensioned within the rubber edge guard of the door between a fixed lower abutment and a resilient upper abutment and the rope is laterally deflected when a person is clamped in the door and the rubber edge guard is deformed. A change in the distance between the end points of the rope takes place upon its lateral deflection and the elastic abutment is deformed and actuates the switch, which switches the door drive to "open".

This known anti-closing device has a relatively low sensitivity of response and requires a considerable deflection of the rope in order to deform the resiliently deformable abutment to such an extent that it produces a switching operation. Another disadvantage is that the known anti-closing device is not always operative in the lower region of the door where the fixed abutment is located. The fixed abutment in the known embodiment is, to be sure, provided with an articulation connection which permits the abutment to move away perpendicular to the plane of the door when it encounters resistance, for instance, a foot of a person. However, this articulation connection of the fixed abutment is not active in the direction of the plane of the door. Furthermore, it is of very complicated construction and is highly susceptible to breakdown since when actuated in accordance with its intended use a loose articulation roller can drop out, whereby the articulation connection becomes non-operative.

SUMMARY OF THE INVENTION

An object of the present invention is to avoid these disadvantages and to provide an anti-closing device for use with automatically opening and closing doors which has a high sensitivity of response, is practically insensitive to variations in temperature, is fully active over its entire length, particularly in the lower region where a person's foot would be contacted, and which can be manufactured at relatively low cost and installed in existing doors.

This object is achieved, in accordance with the invention, by the construction comprising a plurality of sleeves arranged one after the other on the flexible pull means, the end surfaces of the sleeves which face each other being in adjoining relation in the rest condition and having a substantially larger outside diameter than the diameter of the pull means which is surrounded by the sleeves.

This construction has the advantage that the distance between the points of attachment of the rope can be significantly shortened even with only a slight deflection of the row of sleeves and a precise switching operation can be thereby brought about. This large change in distance, which will be referred to below for the sake of simplicity as "change in length of the rope" although actually the total length of the rope does not change, is brought about in the manner that the facing end surfaces of the sleeves move away from each other in the region of the longitudinal axis of the sleeve in which the pull means extends when the sleeves, upon lateral deflection, form a polygonal shape and their end surfaces rest against each other only at an edge point. The pull means, which extends within the row of sleeves, must also bridge over these spacings so that it becomes apparently shorter and exerts a pulling force on its resiliently yieldable abutment.

The pull means can be a rope, a chain, a flexible wire or the like and can be covered with an anti-corrosion tubing which rests closely against it. In this connection, the sleeves can surround the pull means or the corrosion protection tubing tightly but in longitudinally movable manner.

The sleeves may be made of plastic and be provided with end flanges at both of their ends, said flanges having a larger diameter than the central region of the sleeve.

The flexible pull means is preferably suspended at one end from a support fastened to the door and biased by a spring, while its other end acts against the row of sleeves which in turn bear against the support. This construction has the advantage that the anti-closing device has, in practice, only one fixed point of suspension which is preferably provided at the upper edge of the door and no fixed abutment is necessary at the lower end.

However, in order to provide the anti-closing device with support also at the lower part of the door, the pull means is preferably supported resiliently for movement in all directions at least at its lower end. In this case, the lower end of the pull means can be anchored in the lowermost or end sleeve which is supported with respect to the edge of the door on an end surface spaced from it on the next sleeve. This construction has the advantage that the end sleeve can also swing in all directions around its point of support when contact is made due to the clamping of a person's foot or other obstacle and can pivot with respect to the next following sleeve, as a result of which the pull means arranged within the row of sleeves is "shortened" and the switching operation is thereby reliably brought about.

The pull means, which is stiffened by the row of sleeves, is preferably supported at its lower end by two resilient wire straps, one of which surrounds the lowermost sleeve and the other the next following sleeve, in each case at a location which is spaced from the abutting end surfaces thereof. This assures, on the one hand, a sufficiently rigid mounting of the anti-closing device and, on the other hand, its dependable operation at the lower edge of the door, since the next following sleeve is held elastically when a pressure is exerted in any direction on the free end of the lowermost sleeve and this lowermost sleeve "buckles" with respect to the next following sleeve.

It is particularly preferable if the pull means is held at a distance from the edge of the door by spring straps which are fastened to the edge of the door and have a free elongated spring arm which is directed opposite the direction of pretensioning of the pull means obliquely with respect to the pull means and has a surface facing away from the support of the pull means which is located in the vicinity of a projection arranged on one of the sleeves. By this construction it is possible to obtain an instantaneous change in length of the pull means, even if the safety device should happen to be contacted precisely at that point where the support of the row of sleeves with respect to the door edge is located.

Namely, if a transverse pressure is exerted on a spring strap constructed in accordance with the invention, then the free spring arm thereof will swing towards the door edge and the end thereof which rests against the sleeve or surrounds it will press against the projection on the sleeve, which it thereby moves in axial direction in opposition to the direction of the pretensioning of the pull means. Since the pull means, for instance a rope or a thin chain, is anchored in the end sleeve, a change in length takes place which brings about the switching operation even if the sleeves which lie closely against each other do not buckle with respect to each other.

The spring straps can, in each case, surround a sleeve in its central part and rest against the lower flange thereof, or else, they can be located at a slight distance from said flange. Special projections on the sleeves are then not necessary.

In order to be able to bring about the above-described switching process even at the end sleeve when someone strikes his foot against the lowermost spring strap which holds the pull means and the end sleeve spaced from the edge of the door, the end sleeve can be provided with an abutment, displaceable in the longitudinal direction of the sleeve at a position which is located at a distance from its end surface which adjoins the next following sleeve. The lower spring strap then rests against this abutment and assures an immediate change in length of the pull means upon deflection. In this connection, the adjustable abutment can be formed by a pin which is inserted in the end sleeve and on which spacer discs can be placed, for adaptation to the position of the lowermost spring strap.

The one end of the pull means is preferably fastened to a switch bolt which is mounted for axial displacement on the support, or a part connected with it, and the bolt is surrounded by a coil compression spring which, on the one hand, bears against the support or the part connected with it and on the other hand against a spring abutment which is connected to the switch bolt. In this case, the free end of the switch bolt preferably cooperates with a switch surface of an electronic capacitance switch which is adjustably mounted on the support.

This construction permits a very accurate adjustment of the pull means and assures a high switching sensitivity. A change in length of the pull means of a few millimeters is sufficient to bring about the switching operation and reverse the door drive.

The switch bolt can be surrounded by a bushing into which the electronic capacitance switch is screwed so as to be displaceable with respect to the switch bolt. In this way, the switch can be adjusted very precisely in a very simple manner.

The support can be a U-shaped support bracket whose web is fastened to the edge of the door and whose lower flange has a support plate for the row of sleeves, said flange having an opening through which the pull means passes. The upper flange of the support bracket can have a hole which is aligned with the opening in the lower flange and in which the spring-loaded switch bolt is guidably adjusted. In another embodiment, a guide roller can be mounted on the support bracket, over which roller the pull means is returned to the lower flange and connected to the spring-loaded switch bolt which is displaceably mounted thereat. This embodiment has the advantage that the suspension means for the anti-closing device requires only a minimal structural height and the row of sleeves can therefore be brought almost up to the upper edge of the door.

Other features and advantages of the invention will become evident from the following description and drawings of preferred embodiments of the invention, which will be described in further detail.

BRIEF DESCRIPTION OF THE FIGURES OF THE DRAWING

FIG. 3 is a longitudinal section through the apparatus in FIG. 2 in which the anti-closing device of the invention is seen in side view upon its actuation.

FIG. 6 is a sectional view of a detail of FIG. 3.

FIG. 7 is a side view of the upper attachment of the anti-closing device with the switch, partially in section.

DETAILED DESCRIPTION

Figure 1:
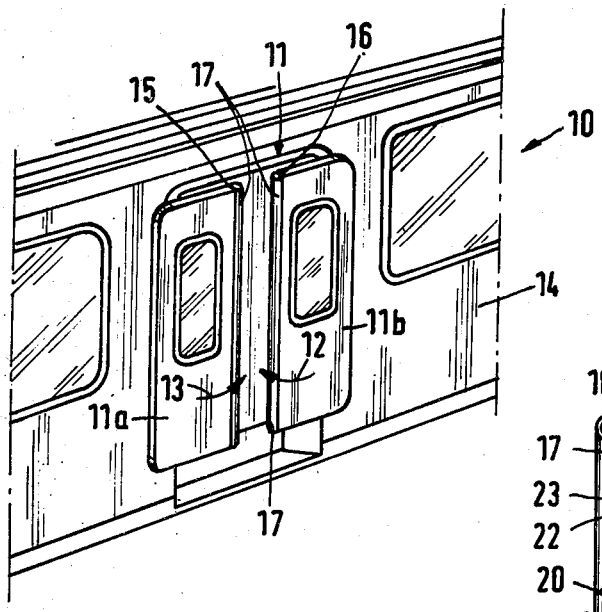
FIG. 1 is a perspective view of a portion of a trolley car having an automatic double door provided with an anti-closing device in accordance with the invention.

In the drawing, there is seen a trolley car 10 which has a double door 11, the two doors 11*a* and 11*b* of which swing outwardly and to the side upon opening, while upon closing they move towards each other in the directions indicated by arrows 12 and 13 until they have come into the plane of the side wall 14 of the trolley car and the rubber edge guard strips 17 arranged on the facing door edges 15 and 16 rest against each other.

The rubber edge guard strips each consists of a wide strip of rubber which is fastened at its two edges near the door edges 15 and 16 respectively to the doors 11*a* and 11*b* respectively and forms, with the door edges 15 and 16 respectively, an elongated hollow space or chamber. An anti-closing device 20 of the invention is arranged in the hollow space.

The anti-closing device 20 comprises a wire rope 22 stiffened by a row of sleeves 21. The upper end 23 of the rope is suspended in a manner which will be described in further detail later from a support 24 while the lower end 25 is anchored to the end sleeve 26 of the row of sleeves 21.

Figure 8:
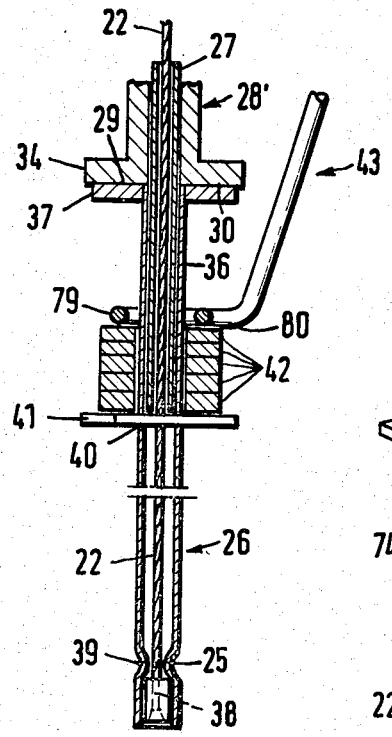
FIG. 8 is a longitudinal section of the lower end of the anti-closing device.

The wire rope 22 is covered by a plastic tube 27 which closely adjoins it and provides corrosion protection. The tube 27 is surrounded by the row of sleeves 21 which comprises a plurality of identical sleeves 28 and the end sleeve 26. The sleeves have end surfaces 29 and 30 which are in abutment and are aligned on the rope 22. The sleeves 28 are made of hard plastic material and are provided at their opposite ends 31 and 32 with end flanges 33 and 34 whose diameter D is larger than the diameter d of the sleeves in their central region 35. The end sleeve 26 comprises a thin steel pipe 36 which is provided at its upper end with a flange plate 37 the diameter of which is equal to that of the end flange 34 of the next following sleeve 28'. The rope 22 is provided at its lower end 25, with a thickening 38, for instance, a block of steel or lead clamped thereon or a knot, which is prevented from moving upwardly in the end sleeve 26 by a cross-sectional constriction 39 in the steel pipe 36 and thus anchors the pull means 22 in the end sleeve 26 (FIG. 8).

At a certain distance from the flange plate 37 there is provided in the end sleeve 26 a dimetral borehole 40 through which there is passed a pin 41 which supports a plurality of spacer discs 42. On the top spacer 42 of the stack there rests a resilient wire spring 43 the manner of construction and action of which will be explained later.

The suspension switch device of the anti-closing device of the invention can best be seen in FIG. 7. Therein, the support 24 is seen to be a U-shaped bracket whose web 44 is fastened by screws 45 to the edge 16 of the door.

The upper flange 46 of the support bracket is provided at its outer end with a borehole 47 which is aligned with a corresponding opening 48 in the lower flange 47 of the support bracket. In the opening 48 of the lower flange 49 there is inserted a length of pipe 51 provided with an external thread 50 and secured by a nut 52. The pipe 51 supports, on the end thereof extending beyond the lower surface of the lower flange, a flange plate 53 which preferably has the same diameter as the end flanges 33 and 34 of the sleeves 28. The pull means 22 passes through the pipe 51 and is provided at its upper end 23 with a loop 54 which is suspended from a ring 55 at the lower end of a switch bolt 56 which passes through the borehole 47 in the upper flange 46 of the supporting bracket 24 and is guided for longitudinal displacement in a collar 57 welded to the flange 46. The switch bolt 56, at its other end 58 facing away from the rope 22, supports a spring washer 59 against which bears a coil compression spring 60 whose other end bears against the free end surface 61 of the collar 57, the spring surrounding the switch bolt 56. The coil compression spring 60 exerts a strong pull in the direction indicated by the arrow 62 on the rope 22. Since the rope 22 can slide freely in the pipe 51 and in the sleeves 28 and is anchored at the lower end of the end sleeve 26 by the thickening 38, the end sleeve 26 is pulled upwardly and its flange plate 37 presses the sleeves 28 arranged above it together and against the abutment plate 53 fastened to the lower flange 49 of the wire bracket 24. Since the end surfaces 29 and 30 of the end flanges 33 and 34 as well as of the flange plates 37 and 53 lie closely against each other, the rope 22 serving as the pull means is stiffened by the sleeves 28 and 26 as in the Indian rope trick. Since the pull means 22 which is stiffened in this manner is held at its upper end by the lower flange 49 of the bracket 24 at a distance from the edge of the door, it is sufficient to hold the row 21 of sleeves at the lower end in spaced relation from the edge of the door 16 by at least one spring strap 43 in order to avoid swinging motions of the sleeve row 21 and to make the anti-closing device operable.

A fixed abutment for the pull means is, however, not necessary at the lower end, since the rope 22 rests via the row of sleeves 21 against the support 24 which also forms the abutment for the compression coil spring 60 and takes up the tensile force which is exerted on the rope by the spring.

Referring again to FIG. 7, it can be seen that the switch bolt 56 is surrounded with clearance by a bushing 63 whose lower end 64 is fastened to the collar 57 and whose upper end 65 has an internal thread 66 into which an electronic capacitance switch 67 of known construction is screwed. The electronic capacitance switch 67 is adjustable in the thread 66 and can be locked by a lock nut 68 on the bushing 63. The lower end surface 69 of switch 67 forms a switch surface which cooperates with the spring washer 59 of the switch bolt 56. The spacing of the switch surface from the spring washer 59 can be adjusted by screwing the electronic capacitance switch 67 in and out in the thread 66. Furthermore, it is possible to adjust the basic position of the switch bolt 56 by a self-centering stop-nut 70 which is threaded onto the switch bolt.

Figure 9:
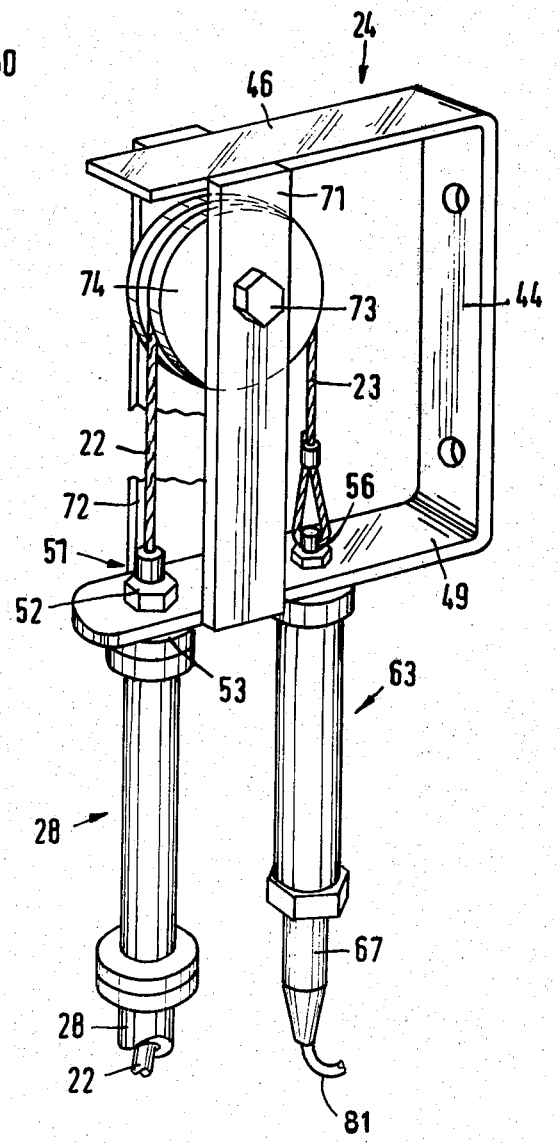
FIG. 9 is a perspective view of another embodiment of the upper suspension of the anti-closing device.

FIG. 9 shows a somewhat different embodiment of the upper suspension of the pull means 22 which is stiffened by the row of sleeves 21. In this embodiment the upper flange 46 and the lower flange 49 of the support 24 are connected to each other by straps 71 and 72 between which a guide roller 74 is mounted on a pin 73, the upper end 23 of the rope 22 extending downwardly over the guide roller. The switch bolt 56, in this case, is mounted for longitudinal displacement in the lower flange 49 of the support 24, and the bushing 62 with the electronic capacitance switch 67 is secured, in the reverse arrangement, to the lower flange 49 of the support 24. Otherwise, the construction and manner of operation are identical to that of the embodiment of FIG. 7. The advantage of the embodiment of FIG. 9 is that the switch device does not take up any additional room above the support 24 and the support 24 can therefore be brought closer to the upper edge of the door, and the row of sleeves which produces the switching operation upon contact with the rubber edge guard can be brought further upward on the door so that the unprotected region of the edge of the door becomes smaller.

In order to stabilize over its entire length, the pull means 22 which is stiffened by the row of sleeves 21 and further increase the switch sensitivity, a plurality of the spring straps 43 are distributed in spaced relation to each other over the height of the door 11 as shown in FIG. 3. Each spring strap 43 consists of a spring wire one end of which is bent to form an eye 75 by which the spring strap 43 is connected by a screw 76 or the like to the door edge 16. Adjoining the eye, the spring strap has a spring eye 77 which is perpendicular to the door edge 16 and consists of one or more turns, adjoining which eye there is an elongated free spring arm 78 which extends downwardly opposite the pretensioning direction 62 of the pull means 22 and obliquely with respect to the pull means or the row of sleeves 21 surrounding the pull means. The free end of the spring arm 78 is bent into an eye 79 extending in a plane substantially parallel to the end surfaces 29 and 30 of the sleeves 28 and 26, respectively, and the ring surface of which, which faces away from the support member 24 of the pull means 22, is located in the vicinity of the lower end flange 34 of a sleeve 28. Only in the case where spring strap 43' which surrounds the sleeve 28' which is adjacent the end sleeve 26 is the eye 79 located approximately in the central region of the sleeve 28', while the lowermost spring strap 43 which holds the end sleeve 26 in spaced relation from the door edge 16 has its lower ring surface 80 resting on the spacer discs 42.

Figure 2:
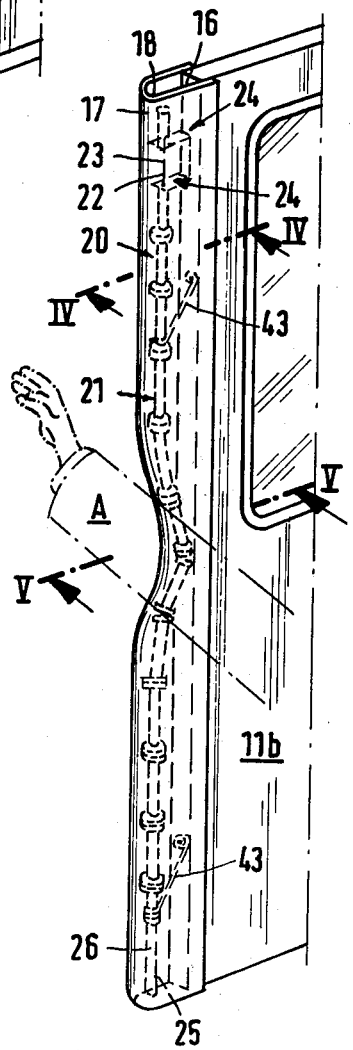
FIG. 2 is a perspective view of a portion of a door having a rubber door edge member associated with an anti-closing device in accordance with the invention.
Figure 4:
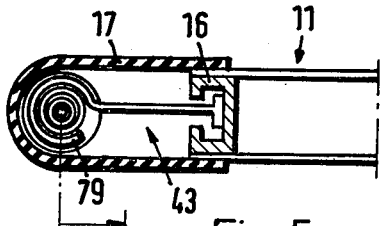
FIG. 4 is a sectional view taken along line IV—IV in FIG. 2.
Figure 5:
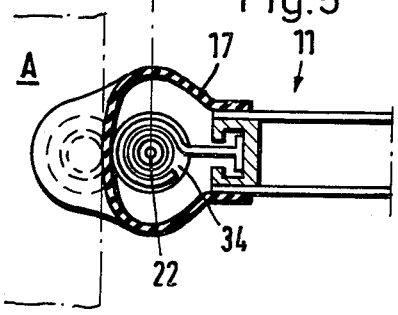
FIG. 5 is a sectional view taken along line V—V in FIG. 2.

The operation of the device is as follows:

When, for instance, upon entering the car or exiting therefrom, a person has his arm A or other limb caught between the closing doors 11*a* and 11*b* of the door 11 and contacts the rubber edge guard 17 at P, the latter is pressed inwardly and deforms the row of sleeves 21 as shown in FIGS. 2 and 3. As a result, the sleeves 28 lying closest to the place of contact P bend away from the adjacent sleeves which are held by the spring straps 43. In undergoing such bending the sleeves pivot on another as seen in FIG. 3.

By deforming the row of sleeves 21, the pull means 22 is deflected laterally and in this way, at the same time, subjected to a tensile stress since the adjacent end surfaces 29 and 30 of two inclined sleeves 28 in the region of their longitudinal axis rapidly move apart from each other while their flanges 33 and 34 still contact each other only at an edge point 82. The flanges 33 and 34 act in this regard as levers which spread the sleeves 28 at their connecting place and push them apart on the rope 22 as seen in FIG. 6.

Since the rope 22 must also cover the distance between the gaping end surfaces 29 and 30 but is not changed in its length and is fastened to the lower end of the row of sleeves 21, it will, upon even only a slight lateral deflection, at one point of the row of sleeves 21, exert a pulling force on the switching bolt 26 and pull the latter downwardly in opposition to the action of the spring 60 and in a direction opposite the pretensioning direction 62. In this way, the distance between the spring washer 59 and the switch surface 69 of the capacitance switch 67 is increased and thereby the switch is actuated, transmitting a switch pulse via an electrical line 81 to the drive motor (not shown) which operates the closing mechanism of the door to reverse the motor so that it opens the door 11.

From FIGS. 3 and 8 it can be seen that the above-described action is dependent on the direction of the deflection of the row of sleeves 21 and that the switching operation is brought about whether a lateral pressure is exerted perpendicularly or obliquely with respect to the plane of the door on the rope 22 which is stiffened by the row of sleeves. Similarly, the switching operation will be brought about if, for instance, a foot of a person strikes against the lower end of the end sleeve 26. Since this sleeve is held by the eye 79 of the bottom spring strap 43, the end sleeve 26 swings in the eye 79, which simultaneously forms an articulation, so that the end sleeve 26 buckles with respect to the next following sleeve 28' and the above-described switching operation is brought about.

If a person accidentally contacts the rubber edge guard and the anti-closing device present behind it at the point at which the eye 79 of a spring strap is located, the deflection is distributed over twice the length of the distance between two spring straps. A perceptible buckling of two or more sleeves with respect to each other may then possibly not occur. Since, however, the spring strap in question is pressed in the direction towards the door edge 16, the eye 79 on the free end of the spring arm 78 also moves in axial direction and thereby presses against the lower flange 34 of the sleeve 28, which it surrounds. In this way, a pull is exerted on the rope in a direction opposite the pretensioning direction 62 via the sleeves which are present below the sleeve 28 and the end sleeve 26 in which the rope 22 is anchored, and in this case the switching operation is also brought about. The same effect also occurs if someone strikes against the eye of the lowermost spring strap 43 since this strap then, upon the swinging of the free spring arm 78, presses against the spacer discs 42 and, via the pin 41, moves the end sleeve 26 downward together with the rope end 25 which is anchored in sleeve 26.

The invention is not limited to the embodiments which have been shown by way of example. For example, it is also possible to form the support and the switching device at the upper end somewhat differently in order to save space and to be able to continue the row of sleeves up to the upper edge of the door. It is also possible to replace the electronic capacitance switch by another switch if any advantage would result therefrom in the specific case. Furthermore, the sleeves 28 and 26 can be constructed somewhat differently, the only essential thing being that their end surfaces which rest against each other have a substantially larger diameter than their axial bore within which the pull means is guided and that they have a projection against which the spring straps 43 can rest. Such changes and additions do not go beyond the concept of the invention.

What is claimed is:

1. An anti-closing device for use with a powered door driven between open and closed positions for opening the door when in the course of being closed the door encounters an obstacle, said device comprising switch means having an actuated state for producing a signal to reverse a drive and open a closing door, a flexible pull means mounted in spaced relation in proximity to a free edge of the door and operatively connected to said switch means for operating the same when the door encounters an obstacle, a plurality of sleeves arranged in a row around said pull means and having adjoining edges in abutment with one another, and means applying tension to said pull means to hold the same in an initially taut state, said pull means being coupled to said sleeves such that when the door encounters the obstacle the sleeves pivot on one another and the pull means is deflected to actuate the switch means, said adjoining edges of said sleeves having outer diameters substantially greater than the diameter of the pull means.

2. A device as claimed in claim 1 comprising corrosion protection means covering said pull means and resting closely thereagainst.

3. A device as claimed in claim 1 wherein said sleeves are mounted in longitudinally displaceable manner around the pull means.

4. A device as claimed in claim 1 wherein said adjoining edges of said sleeves include end flanges which have a larger diameter than the remaining region of the sleeves.

5. A device as claimed in claim 1 wherein said means for applying tension to said pull means comprises a support member affixed to said door, and means resiliently supported by said support member and connected to said pull means at one end thereof, said pull means having an opposite end coupled to said row of sleeves, said row of sleeves bearing against said support member.

6. A device as claimed in claim 5 wherein said pull means is supported, at least at said opposite end for resilient movement in all directions.

7. A device as claimed in claim 5 wherein said pull means and said row of sleeves are arranged vertically, the lowermost of the sleeves being coupled to the lower end of said pull means, said device further comprising means supporting said lowermost of the sleeves from said door at a location spaced from the edge of the lowermost sleeve adjoining the next upper sleeve.

8. A device as claimed in claim 7 wherein said means which supports the lowermost sleeve from the door comprises a resilient wire strap, a second resilient wire strap being provided and connecting the next upper sleeve from the door, said wire straps engaging the respective sleeves at locations spaced from the adjoining edges of said sleeves.

9. A device as claimed in claim 8 comprising further resilient wire straps connecting selected respective sleeves to said door, said straps each having one end connected to said door, a spring arm extending from said one end obliquely with respect to said pull means in a direction opposite to the direction of application of tension to said pull means by said tension applying means, said further resilient wire straps having a surface facing in a direction away from the support member in proximity to the end flange at the lower end of the respective sleeve.

10. A device as claimed in claim 9 wherein said resilient wire straps engage said sleeves in the region between said end flanges.

11. A device as claimed in claim 9 wherein said lowermost sleeve includes abutment means for the respective resilient wire strap, said abutment means being located at a position spaced from the edge adjoining the next uppermost sleeve and in longitudinally adjustable relation along said lowermost sleeve.

12. A device as claimed in claim 11 wherein said abutment means comprises a pin extending through said lowermost sleeve and spacer discs supported on said pin.

13. A device as claimed in claim 5 wherein said means resiliently supported by said support member and connected to said pull means comprises a switch bolt connected to said one end of said pull means and supported for axial displacement relative to said support member, a coil compression spring surrounding said switch bolt and acting on said support member and said switch bolt, said switch means comprising a capacitance switch, said switch bolt having an end surface facing said capacitance switch for selectively operating the same.

14. A device as claimed in claim 13 wherein said switch is adjustably mounted on said support member.

15. A device as claimed in claim 13 comprising a bushing mounted on said support member and surrounding said switch bolt, said switch being threadably engaged with said busing for adjustment relative to said switch bolt.

16. A device as claimed in claim 13 wherein said support member comprises a U-shaped bracket including a web attached to said door and spaced flanges, said row of sleeves bearing against one of said flanges, said one flange having an opening for passage therethrough of said pull means.

17. A device as claimed in claim 16 wherein the other flange of the U-shaped bracket has an opening aligned with the opening in said one flange, said switch bolt being guidably supported in said opening in said other flange.

18. A device as claimed in claim 16 comprising a guide roller supported by said support member, said switch bolt being supported by said one flange, said pull means extending around said guide roller into attachment with said switch bolt.

* * * * *